United States Patent [19]

Matsubara

[11] 4,254,908

[45] Mar. 10, 1981

[54] TIE-PAD ASSEMBLY

[75] Inventor: Kentaro Matsubara, Tokyo, Japan

[73] Assignee: Tokai Rubber Industries, Ltd., Komaki, Japan

[21] Appl. No.: 68,287

[22] Filed: Aug. 20, 1979

[51] Int. Cl.[3] ..... E01B 9/68

[52] U.S. Cl. ..... 238/283

[58] Field of Search ..... 238/264, 283, 287

[56] References Cited

U.S. PATENT DOCUMENTS

| | | | |
|---|---|---|---|
| 2,996,256 | 8/1961 | Moses | 238/283 |
| 3,189,279 | 6/1965 | Horniblow | 238/283 |
| 3,369,753 | 2/1968 | Olson | 238/283 |
| 3,417,922 | 12/1968 | Vaulry | 238/283 |
| 3,549,090 | 12/1970 | Toyama | 238/283 |

*Primary Examiner*—Richard A. Bertsch

*Attorney, Agent, or Firm*—Sughrue, Rothwell, Mion, Zinn and Macpeak

[57] ABSTRACT

A tie-pad assembly is disclosed which includes a rail; a tie and a rectangular tie-pad plate made of relatively soft elastic rubber material having a plurality of longitudinal grooves provided on upper and lower surfaces thereof. A first pair of cutaway portions are formed in lower side edges of the plate in the longitudinal direction of the rail. The tie-pad plate is disposed between the rail and the tie and is provided with a first pair of reinforcement members made of relatively hard elastic rubber material. These members are each formed with an extending portion to be inserted into the first cutaway portions, and a pressure receiving portion having a height somewhat lower than the maximum thickness of the tie-pad plate. The members are integrally coupled to the tie-pad plate by vulcanization; and an aerial gap is formed between the members and the tie-pad plate when assembled, the gap extending along the top surface of the assembly.

5 Claims, 8 Drawing Figures

TIE-PAD ASSEMBLY

BACKGROUND OF THE INVENTION

This invention relates to a novel tie-pad assembly disposed between rail base surfaces and ties or sleepers made of concrete for absorbing vibration generated by the running train.

A conventional rectangular tie-pad 1 made of elastic rubber is provided on both sides with a number of grooves 2 as shown in FIGS. 1 and 2. FIGS. 1 and 2 are a plan view and a cross sectional view thereof, respectively.

With respect to the characteristics of a tie-pad, the spring constant thereof is lowered or the thickness thereof is increased in order to enhance the shock absorbing effect. However, such methods have the following defects. FIG. 3 shows a tie-pad disposed between a rail 3 and a tie or sleeper 4, where numeral 6 designates a pair of rail clips. Side portions a of the tie-pad are extremely expanded by the weights of rails and the train. In a curved portion of the railway, an undesirable phenomenon, so-called "rail tilting" is liable to occur due to a lateral pressure applied to the rails.

SUMMARY OF THE INVENTION

Accordingly, an object of the present invention is to provide a novel construction of a tie-pad assembly to overcome the above-noted defects.

This and other objects of the present invention will be accomplished by providing a tie-pad assembly comprising a relatively soft rubber plate or strip made of elastic material provided along both lower edges with cutaway portions in the railroad direction and a pair of rubber reinforcement members each having an extending portion with which the cutaway portion is filled and a pressure receiving portion integral therewith having a height somewhat lower than the thickness of the rubber plate, the rubber reinforcement members being coupled to the rubber plate by vulcanization thereby forming a gap therebetween in the upper portion.

BRIEF DESCRIPTION OF THE DRAWINGS

The present invention will be hereinafter described in reference to the accompanying drawings in which.

DETAILED DESCRIPTION OF THE INVENTION

Figure 1:
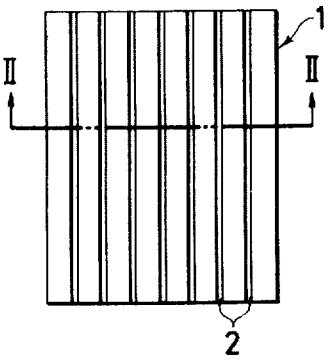
FIG. 1 PRIOR ART
FIG. 1 shows a plan view of a prior art tie-pad.
Figure 2:
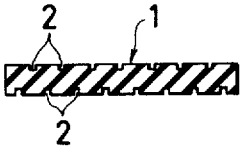
FIG. 2 PRIOR ART
FIG. 2 shows a cross sectional view taken from a line II—II of FIG. 1.
Figure 3:
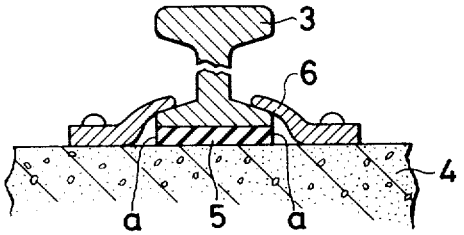
FIG. 3 PRIOR ART
FIG. 3 is in cross section an illustration of a mounting state of the tie-pad according to the prior art method.
Figure 5:
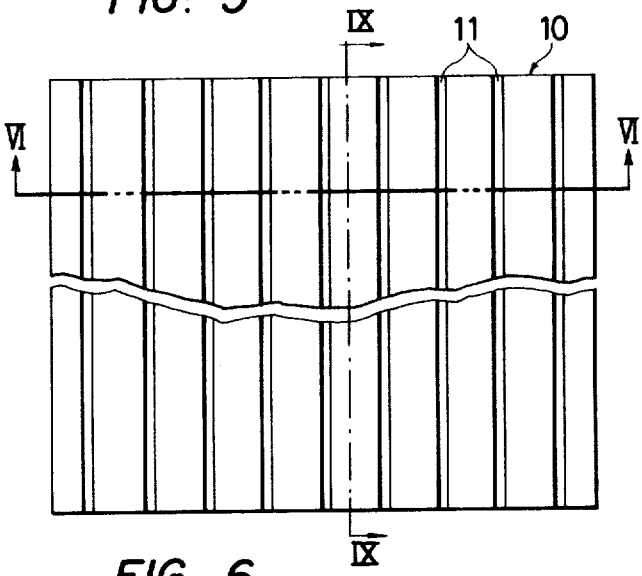
FIG. 5 shows a plan view of a tie-pad according to this invention.
Figure 4:
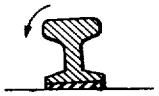
FIG. 4 is a cross section of a rail for illustrating the so-called "rail tilting"
Figure 6:
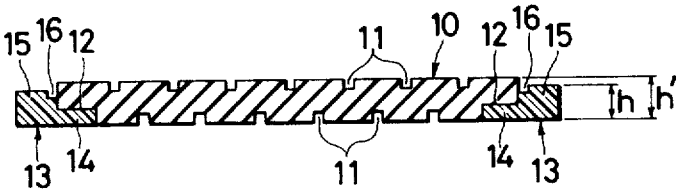
FIG. 6 shows a cross sectional view of tie-pad taken from a line VI—VI of FIG. 5.

Referring now to FIGS. 5 and 6, a rectangular rubber plate 10 is made of soft resilient elastic material having a hardness of Hs 60°, which is softer than a conventional rubber plate by about Hs 10°. A number of thin grooves 11 described hereinafter are provided on both sides of the rubber plate. Longitudinal cutaway portions 12 are formed along both lower side edges of the rubber plate 10 in the railroad direction.

Each of the rubber reinforcement members 13 is made of a hard elastic material, such as a rubber of hardness of Hs 90°, and each member 13 has an extending portion 14 and a pressure receiving portion 15 integral therewith. The extending portion 14 has a cross sectional configuration such that it fills the cutaway portion 12. A height h of the receiving portion 15 is somewhat lower than a height h' of the thickness of the rubber plate 10. In general, when a soft rubber is fully compressed, the maximum compression length thereof is at about 10% of the original length thereof. For this reason, the heights h and h' are suitably determined. Then, the above-described members 13 are partially inserted into the cutaway portions 12 on both sides of the rubber plate with the cutaway portions filled with the extending portions 14. The rubber plate is coupled to the reinforcement members by vulcanization. An aerial space or gap is formed between the rubber plate and the reinforcement member in the upper portion in assembly.

In the thus constructed tie-pad according to this invention, the height h of the pressure receiving portion of the hard elastic rubber reinforcement member (Hs 90°) is somewhat (10%) lower than the height h' of the soft elastic rubber plate (Hs 60°), and the reinforcement members are provided on both lower sides of the rubber plate in the railway direction. Therefore, though the shock absorbing or damping effect is enhanced using a small spring constant, the abnormal expansions toward the rail side directions are prevented. The gap 16 serves to lower the spring constant allowing the rubber plate to be freely deformed. In addition, the so-called "rail tilting" phenomenon is prevented by the resistances of the pressure receiving portions and the extending portions of the hard rubber reinforcement members. Incidentally, the extending portions serve to enhance adhesive force to the rubber plate.

Figure 7:
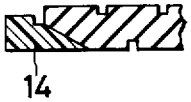
FIG. 7 shows a modification of this invention.

FIG. 7 shows a modification. Though the extending portion 14 of the preceding embodiment is shaped in a rectangular form in cross section, the extending portion 14 may be wedge-shaped as shown in FIG. 7.

Figure 8:
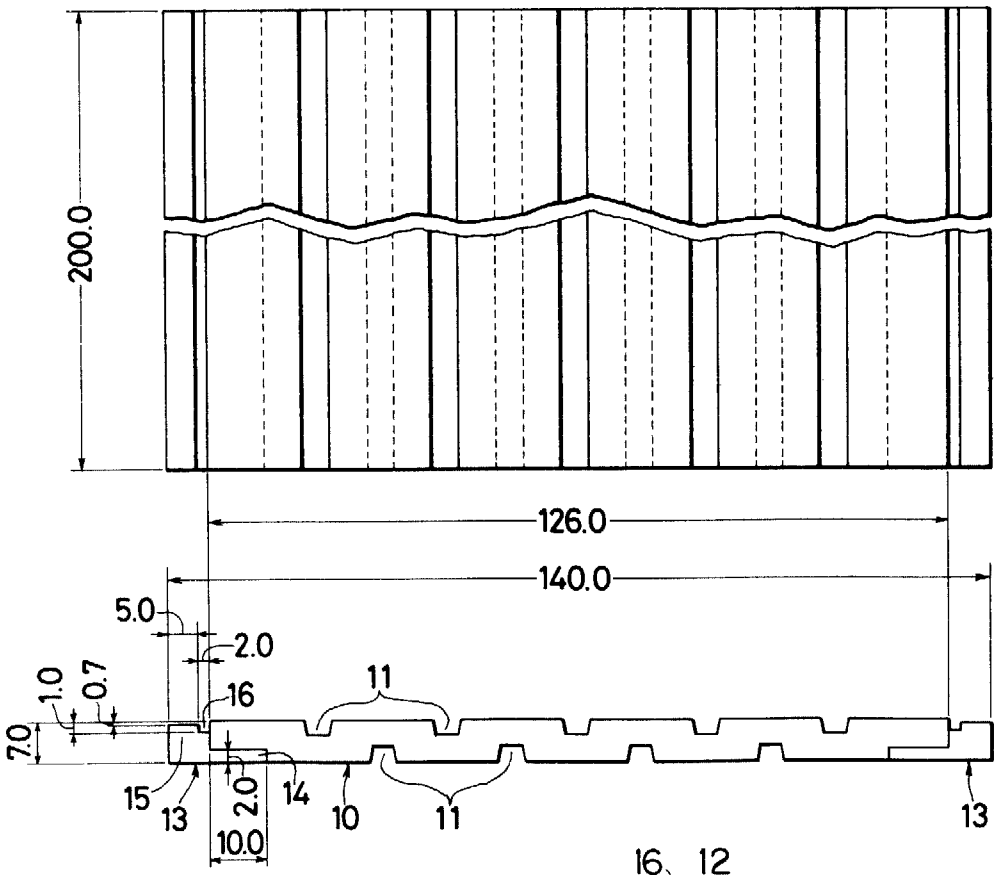
FIG. 8 shows a practical embodiment of the tie-pad assembly according to this invention.
Figure 9:
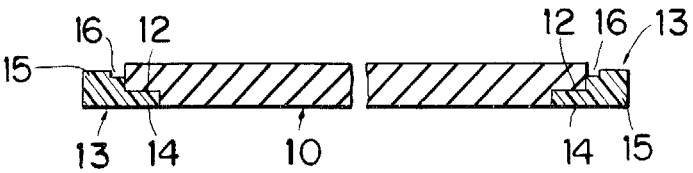
FIG. 9 shows a lateral cross sectional view of the tie-pad taken from a line IX—IX of FIG. 5.

FIG. 8 shows an embodiment of a tie-pad assembly which is practical, according to the present invention. The tie-pad assembly according to the present invention will be practically used in this form. Dimensions in mm used in FIG. 8 are only for reference.

As mentioned above, the rubber reinforcement members are used only along both edges of the rubber plate in the rail direction. It is also obvious to provide the rubber reinforcement members along the edges normal to the railway, of the rubber plate. In this case, cutaway portions are also formed along both edges of the rubber plate, normal to the railway, and the cutaway portions are filled with extending portions of hard rubber reinforcement members, and gaps are formed between the reinforcement member and the rubber plate in the same manner as that of the preceding embodiment, and then they are processed through an integral vulcanization coupling. Accordingly, prevented is undesirable displacement of both edge portions of the rubber plate normal to the railway is prevented. Such displacement is normally due to a waving phenomenon which occurs when the train passes along the railway.

The grooves formed in upper and lower surfaces of the rubber plate serve not only to reduce the spring constant but to enhance frictional forces against the rail and the tie, preventing slippages therebetween.

It is apparent that modifications can be made without departing from the scope of this invention.

We claim:

1. A tie-pad assembly comprising:

a rail;

a tie;

a rectangular tie-pad plate made of relatively soft elastic rubber material, having a plurality of longitudinal grooves provided on upper and lower surfaces thereof and a first pair of cutaway portions formed in lower side edges thereof in the longitudinal direction of the rail, said tie-pad plate being disposed between the rail and the tie;

a first pair of reinforcement members made of relatively hard elastic rubber material, said members each being formed of an extending portion to be inserted into said first cutaway portion and a pressure receiving portion having a height somewhat lower than the maximum thickness of said tie-pad plate, said members being integrally coupled to said tie-pad plate by vulcanization; and an aerial gap having a depth less than the thickness of said members formed between and along the upper surfaces of said members and said tie-pad plate when assembled.

2. A tie-pad assembly as claimed in claim 1, wherein said tie-pad plate has a second pair of cutaway portions formed in lower side edges thereof in the lateral direction of the rail and said assembly further comprises other pair of reinforcement members made of relatively hard elastic rubber material, said second pair of cutaway portions each having an extending portion to be inserted into each of said second pair of cutaway portions and a pressure receiving portion integral therewith, said second pair of reinforcement members being integrally coupled to said tie-pad plate by vulcanization.

3. A tie-pad assembly as claimed in claim 1 or 2, wherein said extending portions have a rectangular shape in cross section.

4. A tie-pad assembly as claimed in claim 1 or 2, wherein said extending portions are wedge-shaped in cross section.

5. A tie-pad assembly as claimed in claim 1 or 2, wherein a height of each of said pressure receiving portions is lower than the maximum thickness of said tie-pad plate by 10% of the maximum thickness.

* * * * *